US008757565B2

(12) United States Patent
Adams et al.

(10) Patent No.: US 8,757,565 B2
(45) Date of Patent: Jun. 24, 2014

(54) HOME APPLIANCE WITH SUPPORT ASSEMBLY

(75) Inventors: David Adams, Norris, TN (US); Michael Rutherford, Duff, TN (US)

(73) Assignee: BSH Home Appliances Corporation, Irvine, CA (US)

( * ) Notice: Subject to any disclaimer, the term of this patent is extended or adjusted under 35 U.S.C. 154(b) by 0 days.

(21) Appl. No.: 13/479,357

(22) Filed: May 24, 2012

(65) Prior Publication Data

US 2013/0313386 A1 Nov. 28, 2013

(51) Int. Cl.
*F16M 11/24* (2006.01)

(52) U.S. Cl.
USPC ..... 248/188.4; 248/188.8; 248/176.3

(58) Field of Classification Search
USPC ..... 248/163.1, 172, 176.3, 188, 188.8, 248/188.9, 181.1, 181.2, 188.4, 188.91, 677
See application file for complete search history.

(56) References Cited

U.S. PATENT DOCUMENTS

| | | | | |
|---|---|---|---|---|
| 2,890,545 | A * | 6/1959 | Fiddler | 248/188.4 |
| 5,104,075 | A * | 4/1992 | Freeman | 248/188.4 |
| 6,186,453 | B1 * | 2/2001 | Redbone | 248/188.4 |
| 6,520,459 | B2 * | 2/2003 | Burr | 248/188.4 |
| 6,742,750 | B2 * | 6/2004 | Burr | 248/188.4 |
| 7,427,052 | B2 * | 9/2008 | Cha et al. | 248/188.8 |
| 8,079,555 | B2 * | 12/2011 | Erdmann et al. | 248/188.4 |
| 8,220,770 | B2 * | 7/2012 | Justis | 248/677 |
| 2006/0266896 | A1 * | 11/2006 | Balistreri | 248/188.4 |

* cited by examiner

*Primary Examiner* — Steven Marsh
(74) *Attorney, Agent, or Firm* — James E. Howard; Andre Pallapies

(57) ABSTRACT

A floor-standing home appliance in the nature of a range including an appliance body and a support assembly for supporting the appliance body on a support surface, the support assembly including a support member extending away from the appliance body, the support member having an engagement member with a predetermined shape at a distal end thereof, and a shoe attached to the distal end of the support member, the shoe having a receiving well with a shape complimentary to the predetermined shape of the engagement member to receive the engagement member in the receiving well.

17 Claims, 5 Drawing Sheets

HOME APPLIANCE WITH SUPPORT ASSEMBLY

BACKGROUND OF THE INVENTION

The present invention relates broadly to floor-standing home appliances and, more particularly, to a home appliance, in the nature of a range, having a two-piece support assembly.

Ranges are generally box-like, floor-standing appliances that include some form of leg support mounted at four corners of the range body. In whatever form, such support should be adjustable so that the height of the range can be varied for appearance and leveling purposes. To that end, some ranges include threaded apertures in the range frame for receiving threaded cylinders that can support the range on a floor and may be rotated in and out of the apertures to adjust the height of the range.

Some ranges are also relatively heavy, weighing more than five hundred (500) pounds. Such weight concentration, on the average of one hundred twenty five (125) pounds per corner, presuming even distribution of weight, can cause difficulties for using threaded cylinders, such as bolts, for support legs. In general, a bolt will be strong enough to support the weight of the range. However, the bolt head presents a small footprint and therefore a high concentration of weight in the form of pressure on the support surface, usually a kitchen floor, which can be damaging to the floor.

Accordingly, feet or shoes have been applied to threaded cylindrical members to make support legs for ranges. Such custom leg structures can be unnecessarily expensive to manufacture and use.

There accordingly exists a need for a support leg assembly that can use a standard bolt and still provide a shoe or foot with a sufficiently large footprint to effectively distribute the weight of a heavy range.

SUMMARY OF THE INVENTION

It is accordingly an object of the present invention to provide a support leg assembly that uses a standard bolt for the support leg with a dedicated shoe that attaches readily to the standard bolt.

It is another object to the present invention to provide such a leg support assembly that will distribute the weight of the range effectively.

To those ends, a floor-standing home appliance includes an appliance body and a support assembly for supporting the appliance body on a support surface. The support assembly includes a support member extending away from the appliance body with the support member having an engagement member with a predetermined shape at a distal end thereof. A shoe is attached to the distal end of the support member, with the shoe having a receiving well with a shape complimentary to the predetermined shape of the engagement member to receive the engagement member in the receiving well.

Preferably, the support member is a threaded cylinder threadedly attached to the appliance body whereby rotation of the support member changes the distance of the appliance body from the support surface and thereby the overall height of the appliance.

It is preferred that the shoe includes a base and an upstanding wall, with the wall defining the receiving well.

The present invention further preferably includes a collar attached to the shoe to retain the engagement member in the receiving well. It is also preferred that the wall defines a threaded cavity and the collar is attached to the shoe using a screw abutting the collar and threadedly received in the threaded cavity. Preferably, the wall defines an opposing pair of threaded cavities and the collar is attached to the shoe using a pair of screws abutting the collar with one screw threadedly received in each of the threaded cavities.

It is preferred that the shoe is configured to provide at least one square inch of support surface contact area for each fifty (50) pounds of appliance weight.

Preferably, the engagement member has a hexagonal shape and the receiving well of the shoe has a complimentary hexagonal shape for receiving the engagement member therein.

It is also preferred that the home appliance includes a support assembly mounted at each of four corners of the appliance body.

The present invention is also directed to a range. In that regard, a floor-standing range includes a range body and a support assembly for supporting the range body on a support surface. The support assembly includes a support member extending away from the range body, with the support member having an engagement member with a predetermined shape at a distal end thereof. Further, a shoe is attached to the distal end of the support member. The shoe has a receiving well with a shape complimentary to the predetermined shape of the engagement member to receive the engagement member in the receiving well.

It is preferred that the support member is a threaded cylinder threadedly attached to the range body whereby rotation of the support member changes the distance of the range body from the support surface and thereby the overall height of the range.

Preferably, the shoe includes a base and an upstanding wall, with the wall defining the receiving well.

The present invention further preferably includes a collar attached to the shoe to retain the engagement member in the receiving well. It is preferred that the wall defines a threaded cavity and the collar is attached to the shoe using a screw abutting the collar and threadedly received in the threaded cavity. Preferably, the wall defines an opposing pair of threaded cavities and the collar is attached to the shoe using a pair of screws abutting the collar with one screw threadedly received in each of the threaded cavities.

It is preferable that the shoe is configured to provide at least one square inch of support surface contact area for each fifty (50) pounds of range weight.

Preferably, the engagement member has a hexagonal shape and the receiving well of the shoe has a complimentary hexagonal shape for receiving the engagement member therein.

It is further preferred that the range includes a support assembly mounted at each of four corners of the range body.

DESCRIPTION OF THE PREFERRED EMBODIMENT

Figure 1:
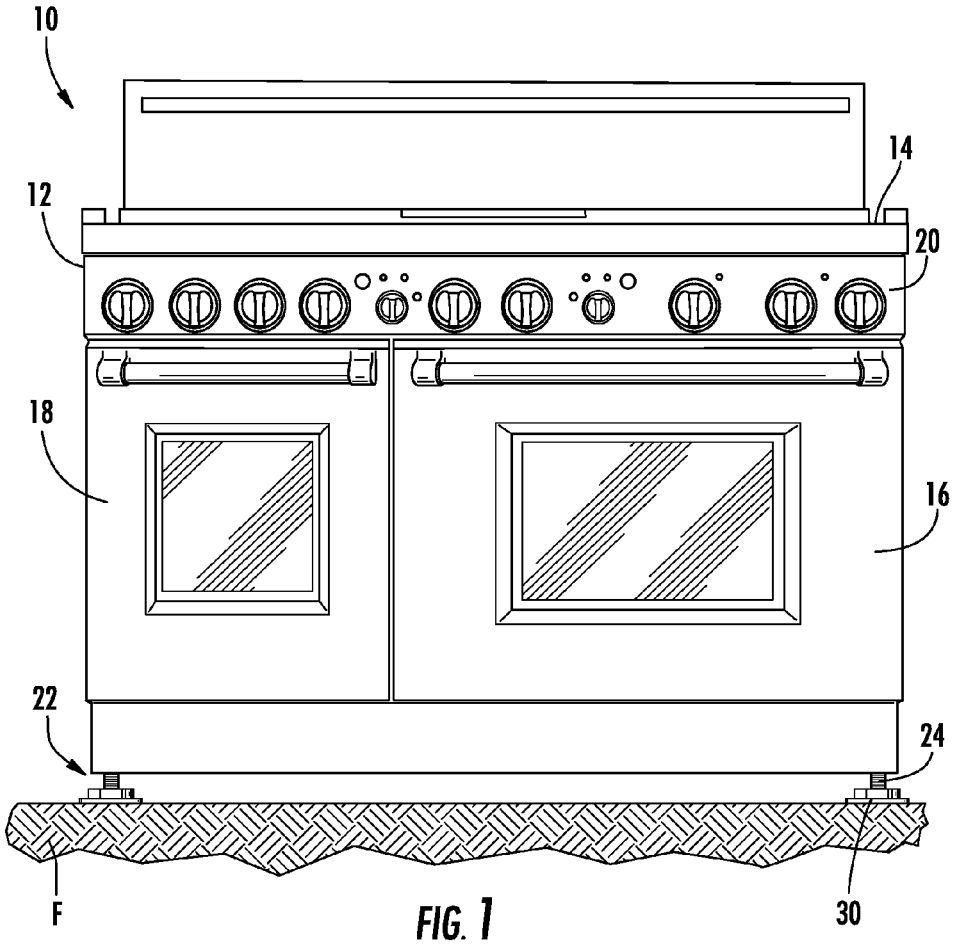
FIG. 1 is a front view of a home appliance with a support assembly according to the preferred embodiment of the present invention.

Turning now to the drawings and, more particularly to FIG. 1, a home appliance in the nature of a range is illustrated generally at 10 includes a generally box-like, floor standing range body 12 with a cooktop 14 mounted to the upper portion of the range body 12. The central portion of the range body 12 defines an oven and a combination steamer and convection oven (not shown). The oven and combination steamer/convection oven are covered by doors illustrated at 16 and 18 respectively. A control panel 20 is located intermediate the cooktop 14 and the doors 16, 18. The range body 12 is supported on a support surface such as a floor F by the present support assembly 22. It should be noted that the support assembly 22 is shown in FIG. 1 with a somewhat exaggerated size for clarity. The support assembly 22 includes two primary components. These include a generally cylindrical, threaded support leg 24 and a shoe 30 fitted to the support leg 24.

Figure 2:
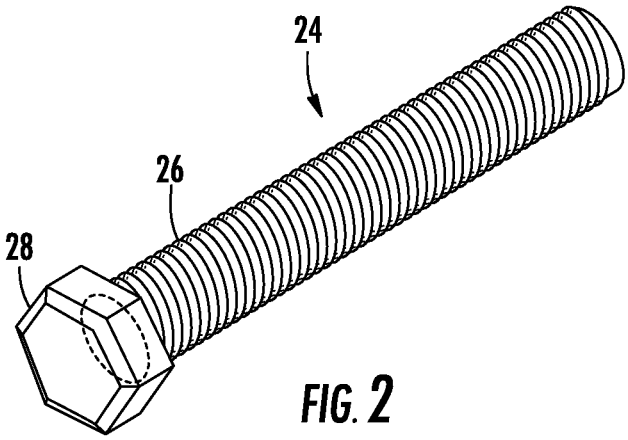
FIG. 2 is a perspective view of a threaded support leg as illustrated in FIG. 1.

Turning now to FIG. 2, the support leg 24 is a threaded cylinder 26 having a hexagonal head 28 attached to a distal end of the support leg 24. The support leg 24 is threadedly received in a threaded aperture on the frame (not shown) underlying the range body 12 in a known manner. Rotation of the support leg 24 causes the leg to move toward and away from the range, thereby providing height adjustment.

Figure 3:
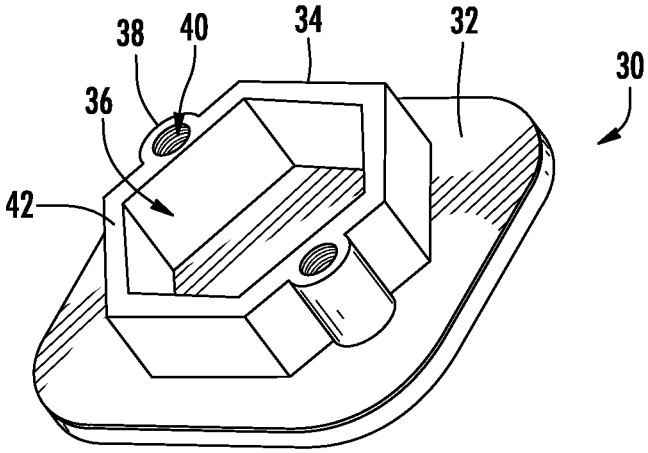
FIG. 3 is a perspective view of the support shoe illustrated in FIG. 1.

As seen in FIG. 3, a shoe 30 includes a generally square base 32 with smoothly rounded corners. A hexagonal wall 34 projects away from the base 32 and defines a hexagonal cavity 36 within the perimeter of the wall 34. Internally threaded cylinders 38 are formed integrally the wall 34 along two sides of the wall 34 in opposition to one another. The internally threaded cylinders 38 define threaded cavities 40 for receipt of screws. The wall 34 defines a rim 42 along an outer edge thereof.

Figure 4:
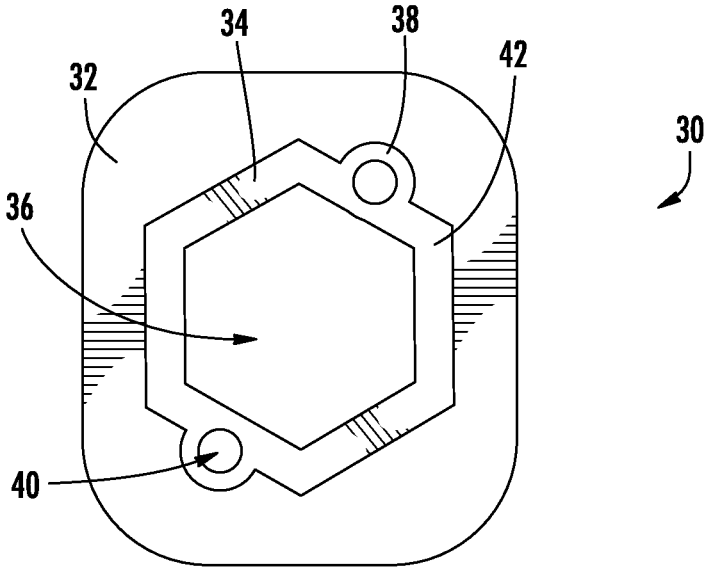
FIG. 4 is a top plan view of the support shoe illustrated in FIG. 3.

FIG. 4 illustrates the shoe 30 from above and fully reveals the generally square base 32 with rounded corners and the orientation of the wall 34 with the internally threaded cylinders 38 generally aligned with two of the corners of the base 32. The shoe 30 is configured to provide at least 1 $in^2$ of contact for each fifty (50) pounds of appliance weight. For example, an approximately five hundred (500) pound appliance would distribute about one hundred twenty five (125) pounds per support leg assembly, presuming even weight distribution and a support assembly at each of four corners of the range body 12. The area of the contact surface of the shoe 30 would therefore be about 2½ $in^2$.

Figure 5:
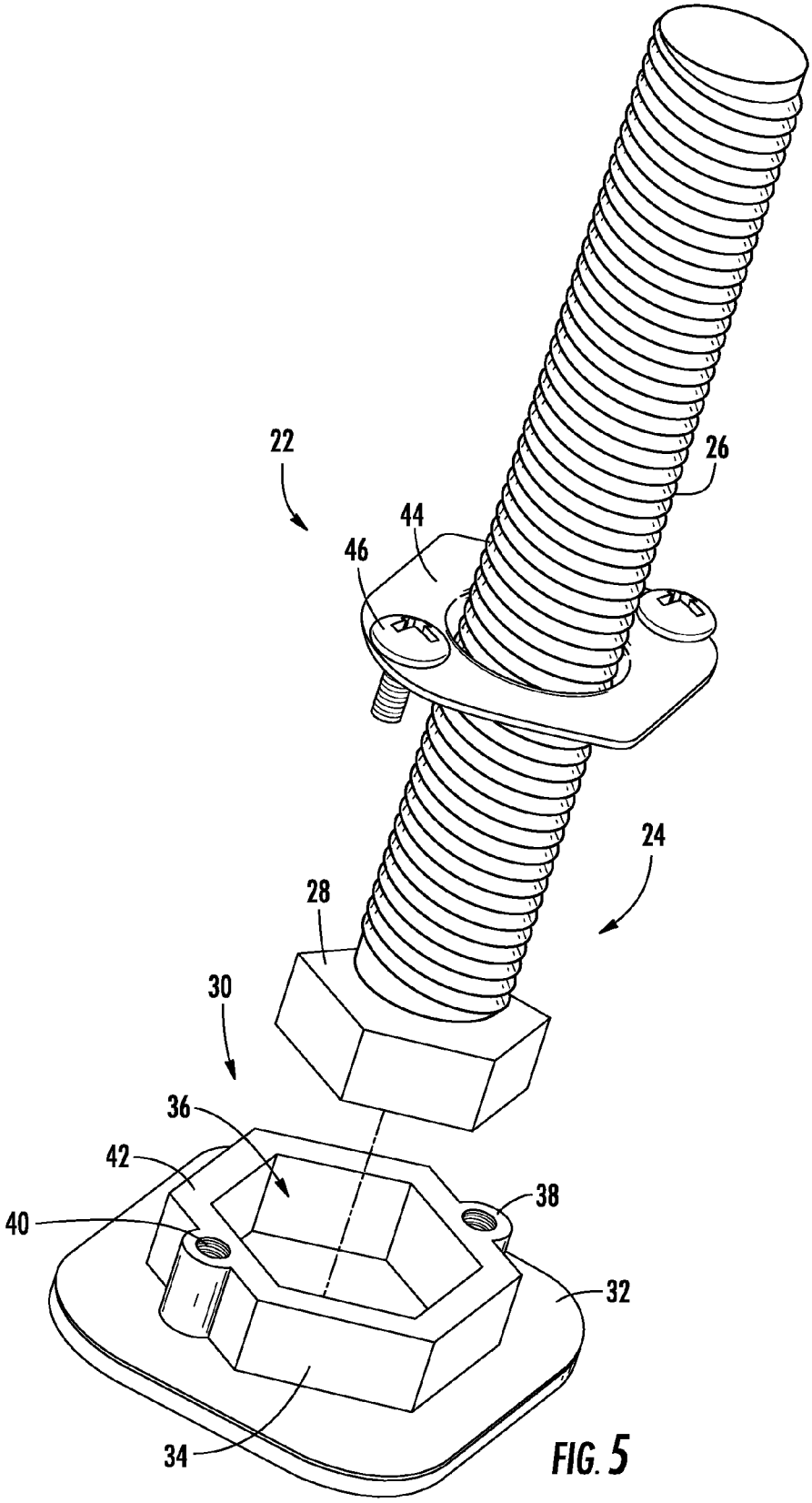
FIG. 5 is an exploded view of the support assembly illustrated in FIG. 1.

Turning now to FIG. 5, the general relationship between the support leg 24 and the shoe 30 is illustrated with respect to the support assembly 22. The receiving cavity 36 in the shoe 30 is hexagonally shaped in a complimentary manner to the head 28 of the support leg 24 and is configured to receive and snugly support the head 28 of the support leg 24. The support leg 24 can be a standard bolt which, preferably, is a ⅝-11, 5" (inch) bolt.

A generally diamond-shaped planar collar 44 is also included in the support assembly 22. The collar 44 includes an opening through which the shaft 26 of the support leg 24 may pass, resulting in the collar 44 surrounding the threaded shaft 26 of the support leg 24. The collar 44 is configured for retention against the rim 42 of the wall 34.

Figure 6:
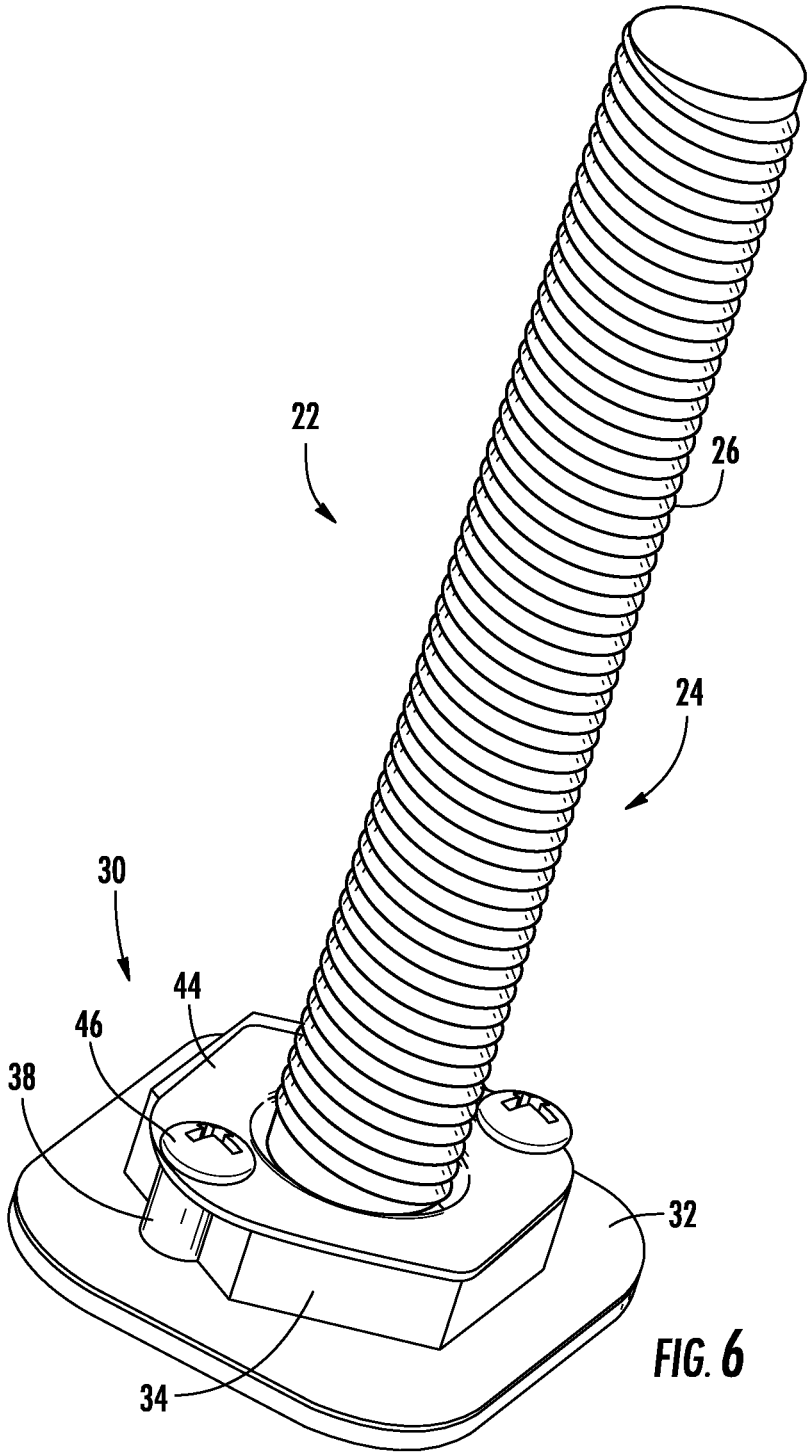
FIG. 6 is a perspective view of the support assembly illustrated in FIG. 1.

As seen in FIG. 6, the support leg assembly 22 is assembled and the support leg 24 is mounted to the shoe 30. The hexagonal head 28 is received snugly within receiving cavity 36 of the wall 34 with the collar 44 abutting the rim 42 of the wall 34. The collar 44 is attached using screws 46 that are threadedly engaged with the internally threaded cylinders 38 to firmly retain the shoe 30 in place. The support leg assembly 22 is therefore ready for mounting to a range 10, as illustrated in FIG. 1.

By the above, the present invention provides a height adjustable support assembly for a home appliance in the nature of a range that allows the use of a conventional bolt as a leg and provides a firmly attached foot or shoe that provides ample support for the weight of the appliance and helps distribute the weight of the appliance to prevent damage to both the appliance and the support surface.

It will therefore be readily understood by those persons skilled in the art that the present invention is susceptible of a broad utility and application. While the present invention is described in all currently foreseeable embodiments, there may be other, unforeseeable embodiments and adaptations of the present invention, as well as variations, modifications and equivalent arrangements, that do not depart from the substance or scope of the present invention. The foregoing disclosure is not intended or to be construed to limit the present invention or otherwise to exclude such other embodiments, adaptations, variations, modifications and equivalent arrangements, the present invention being limited only by the claims appended hereto and the equivalents thereof.

What is claimed is:

1. A floor-standing home appliance comprising:

an appliance body; and a support assembly for supporting the appliance body on a support surface, the support assembly including:

a threaded support member extending away from the appliance body, the support member having a shaft and an engagement member having a predetermined shape with a multi-faceted distal end, with the shaft threads extending from the appliance body to the distal end; and a shoe attached to the distal end of the support member, the shoe having a generally planar platform with a multi-faceted wall projecting upwardly from the platform terminating in a planar rim and defining a receiving well having a floor and inner wall surfaces, the inner wall surfaces being formed with a multi-faceted shape complimentary to the predetermined shape of the engagement member, with the receiving well having an open top portion larger than the engagement member and configured to receive the engagement member in the receiving well with the engagement member in contact with the inner walls and floor of the receiving well, wherein the shoe and support member are configured to preclude relative movement therebetween.

2. The home appliance of claim 1 wherein the support member is a threaded cylinder threadedly attached to the appliance body whereby rotation of the support member changes the distance of the appliance body from the support surface and thereby the overall height of the appliance.

3. The home appliance of claim 1 and further comprising a generally planar, one-piece collar attached to the shoe to retain the engagement member in the receiving well wherein the collar abuts the wall forming the receiving well without abutting the shaft.

4. The home appliance of claim 3 wherein a threaded cavity is formed in the wall and the collar is attached to the shoe using a screw abutting the collar and threadedly received in the threaded cavity, wherein the entire engagement member is received in the receiving well and the collar does not engage the engagement member.

5. The home appliance of claim 3 wherein the wall defines an opposing pair of threaded cavities and the collar is attached to the shoe using a pair of screws abutting the collar with one screw threadedly received in each threaded cavity.

6. The home appliance of claim 1 wherein the shoe is configured to provide at least one square inch of support surface contact area for each fifty pounds of appliance weight.

7. The home appliance of claim 1 wherein the engagement member has a hexagonal shape and the receiving well of the shoe has a complimentary hexagonal shape for receiving the engagement member therein.

8. The home appliance of claim 1 wherein the home appliance includes a support assembly mounted at each of four corners of the appliance body.

9. A floor-standing range comprising:

a range body; and a support assembly for supporting the range body on a support surface, the support assembly including:

a threaded support member extending away from the appliance body, the support member having a shaft and an engagement member having a predetermined shape with a multi-faceted distal end, with the shaft threads extending from the appliance body to the distal end; and a shoe attached to the distal end of the support member, the shoe having a generally planar platform with a multi-faceted wall projecting upwardly from the platform terminating in a planar rim and defining a receiving well having a floor and inner wall surfaces, the inner wall surfaces being formed with a multi-faceted shape complimentary to the predetermined shape of the engagement member, with the receiving well having an open top portion larger than the engagement member and configured to receive the engagement member in the receiving well with the engagement member in contact with the inner walls and floor of the receiving well, wherein the shoe and support member are configured to preclude relative movement therebetween.

10. The range of claim 9 wherein the support member is a threaded cylinder threadedly attached to the range body whereby rotation of the support member changes the distance of the range body from the support surface and thereby the overall height of the range.

11. The range of claim 9 and further comprising a generally planar, one-piece collar attached to the shoe to retain the engagement member in the receiving well wherein the collar abuts the wall forming the receiving well without abutting the shaft.

12. The range of claim 11 a threaded cavity is formed in the wall and the collar is attached to the shoe using a screw abutting the collar and threadedly received in the threaded cavity, wherein the entire engagement member is received in the receiving well and the collar does not engage the engagement member.

13. The range of claim 12 wherein the wall defines an opposing pair of threaded cavities and the collar is attached to the shoe using a pair of screws abutting the collar with one screw threadedly received in each threaded cavity.

14. The range of claim 9 wherein the shoe is configured to provide at least one square inch of support surface contact area for each fifty pounds of range weight.

15. The range of claim 9 wherein the engagement member has a hexagonal shape and the receiving well of the shoe has a complimentary hexagonal shape for receiving the engagement member therein.

16. The range of claim 9 wherein the range includes a support assembly mounted at each of four corners of the range body.

17. A floor-standing home appliance comprising:

an appliance body; and a support assembly for supporting the appliance body on a support surface, the support assembly including:

a threaded support member extending away from the appliance body, the support member having a shaft and an engagement member having a predetermined shape with a multi-faceted distal end, with the shaft threads extending from the appliance body to the distal end;

a shoe attached to the distal end of the support member, the shoe having a generally planar platform with a multi-faceted wall projecting upwardly from the platform defining a receiving well with a multi-faceted shape complimentary to the predetermined shape of the engagement member, with the receiving well having an open top portion configured to receive the engagement member in the receiving well, wherein the shoe and support member are configured to preclude relative movement therebetween; and a generally planar, one-piece collar attached to the shoe to retain the engagement member in the receiving well wherein the collar abuts the wall forming the receiving well without abutting the shaft.

* * * * *